US008490750B2

(12) United States Patent
Balquist et al.

(10) Patent No.: US 8,490,750 B2
(45) Date of Patent: Jul. 23, 2013

(54) ENERGY ABSORBING LIFELINE SYSTEMS

(75) Inventors: Ross Balquist, Slippery Rock, PA (US); Thomas W. Parker, Jamestown, PA (US)

(73) Assignee: Honeywell International Inc., Morristown, NJ (US)

( * ) Notice: Subject to any disclaimer, the term of this patent is extended or adjusted under 35 U.S.C. 154(b) by 562 days.

(21) Appl. No.: 12/391,721

(22) Filed: Feb. 24, 2009

(65) Prior Publication Data

US 2009/0211847 A1 Aug. 27, 2009

Related U.S. Application Data

(60) Provisional application No. 61/031,343, filed on Feb. 25, 2008, provisional application No. 61/045,834, filed on Apr. 17, 2008.

(51) Int. Cl.
*A62B 1/08* (2006.01)
*A62B 35/00* (2006.01)

(52) U.S. Cl.
USPC ..... 182/231; 182/236

(58) Field of Classification Search
USPC ..... 182/231, 234, 236, 239
See application file for complete search history.

(56) References Cited

U.S. PATENT DOCUMENTS

| | | | | |
|---|---|---|---|---|
| 3,927,846 | A * | 12/1975 | Meissner | 242/379.1 |
| 4,511,123 | A * | 4/1985 | Ostrobrod | 254/364 |
| 6,260,782 | B1 * | 7/2001 | Smithson et al. | 242/379.1 |
| 2002/0092943 | A1 * | 7/2002 | Koning et al. | 242/379.1 |
| 2002/0148925 | A1 * | 10/2002 | Cox et al. | 242/608.6 |
| 2004/0118968 | A1 * | 6/2004 | Sanda | 242/613.4 |
| 2006/0054730 | A1 | 3/2006 | Paterson | |

FOREIGN PATENT DOCUMENTS

| | | | |
|---|---|---|---|
| GB | 2167647 | A * | 6/1986 |
| JP | 10129414 | A * | 5/1998 |
| JP | 11227561 | A * | 8/1999 |

OTHER PUBLICATIONS

Titan Safety Belts & Fall Protection Devices' Catalog, Sanko Industries Co., LTD., 2007.
Catalog Retractable Lifelines Catalog, Antec, Oct. 2005.

* cited by examiner

*Primary Examiner* — Alvin Chin Shue
(74) *Attorney, Agent, or Firm* — Wood, Phillips, Katz, Clark & Mortimer

(57) ABSTRACT

A lifeline system includes a lifeline and a hub around which the lifeline is coiled. The hub deforms to absorb energy at a predetermined level of force exerted thereon by the lifeline. For example, the hub can be deformable to absorb energy so that a peak fall arrest force in a drop test of the lifeline system with a 220 pound mass attached to the lifeline over a distance of up to 6.56 feet is not more than 1900 pounds. In several embodiments, the peak fall arrest force is no more than 1500 pounds or no more than 1349 pounds.

33 Claims, 14 Drawing Sheets

SECTION A-A

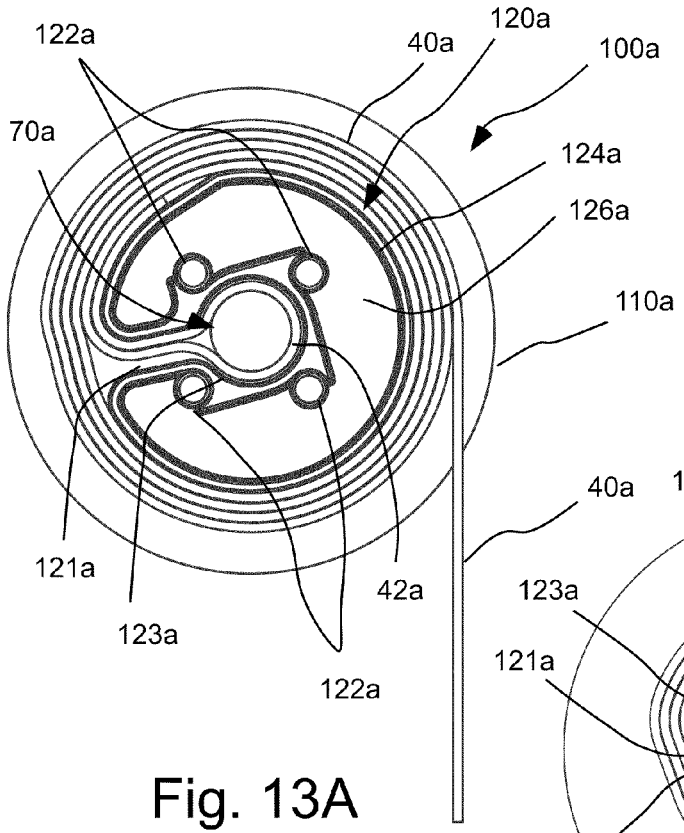
Fig. 13A
Fig. 13B
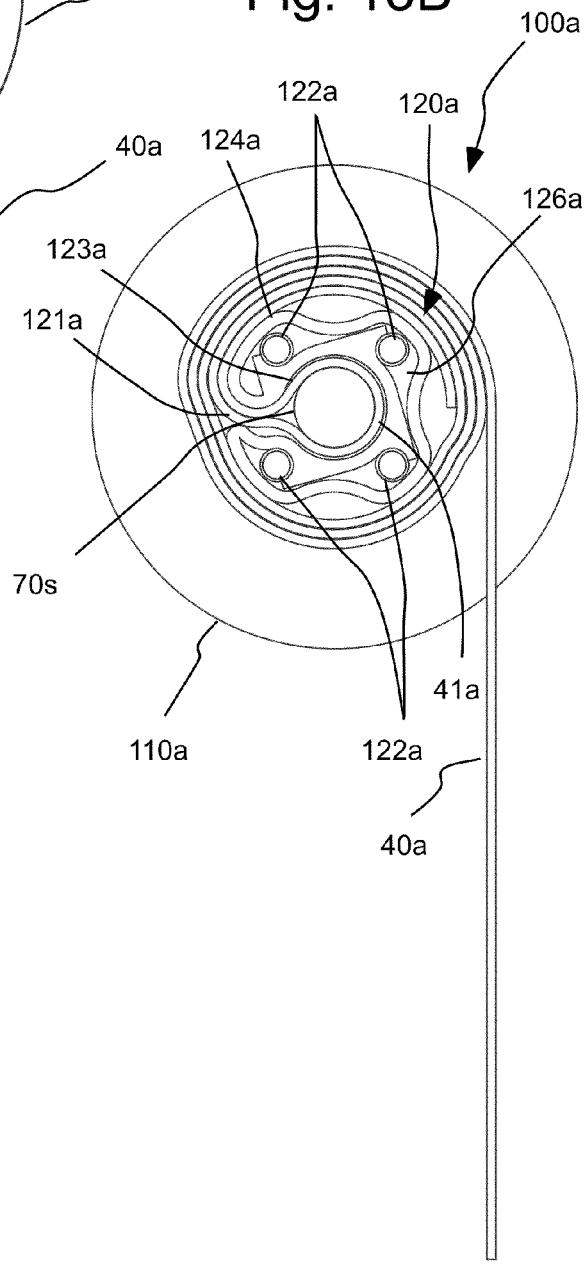

ENERGY ABSORBING LIFELINE SYSTEMS

CROSS-REFERENCE TO RELATED APPLICATION

This application claims benefit of U.S. Provisional Patent Application Ser. No. 61/031,343, filed Feb. 25, 2008 and U.S. Provisional Patent Application No. 61/045,834, filed Apr. 17, 2008, the disclosures of which are incorporated herein by reference.

BACKGROUND OF THE INVENTION

The present invention relates to lifeline systems and, particularly, to self-retracting lifeline systems including an energy absorbing mechanism or system.

The following information is provided to assist the reader to understand the invention disclosed below and the environment in which it will typically be used. The terms used herein are not intended to be limited to any particular narrow interpretation unless clearly stated otherwise in this document. References set forth herein may facilitate understanding of the present invention or the background of the present invention. The disclosures of all references cited herein are incorporated by reference.

Many devices have been developed in an attempt to prevent or minimize injury to a worker falling from a substantial height. For example, a number of devices (known alternatively as self-retracting lifelines, self-retracting lanyards, fall arrest blocks, etc.) have been developed that limit a worker's free fall distance to a specified distance and limit fall arresting forces to a specified value.

In general, most currently available self retracting lifeline safety devices or systems include a number of common components. Typically, a housing or cover provides enclosure/protection for the internally housed components. The housing includes attached thereto a connector for anchoring the self-retracting lifeline to either the user or to a fixed anchor point. The connector must be capable of withstanding forces required to stop a falling body of a given mass in a given distance.

A drum or spool around which a lifeline is coiled or spooled rotates within the housing. The drum is typically under adequate rotational tension to reel up excess extended lifeline without hindering the mobility of the user. Like the anchor connector and the other operative components of the retractable lifeline safety device, the drum is formed to withstand forces necessary to stop a falling body of a given mass in a given distance. The lanyard or lifeline is attached at one end thereof to the drum to allow the drum to reel in excess lifeline. The lifeline is attached at the other end thereof to either the user or to an anchorage point, whichever is not already attached to the housing.

Self-retracting lifeline systems also include a mechanism which locks (that is, prevents rotation of) the drum assembly of the self-retracting lifeline upon indication that a fall is occurring. For example, when the rope, cable or web being pulled from the self-retracting lifeline system causes the drum assembly to rotate above a certain angular velocity or experience an angular acceleration above a certain level, a brake mechanism can cause the drum assembly to suddenly lock.

Given the forces experienced by self-retracting lanyards upon sudden locking of drum rotation, the operational components of self-retracting lanyard are typically manufactured from high-strength materials such as stainless steel to ensure locking, while withstanding the stresses associated therewith.

In that regard, though the fall may be stopped upon actuation of the braking mechanism of a self-retracting lanyard, the suddenness of the stop may cause injury to the user or produce higher than desirable stresses in one more components of the safety system.

In a low-cost variant of a self-retracting lifeline available under the name STOPMAX EVOLUTION™ from Antec of Vierzon, France (a division of Sperian Protection), a number of components, including the drum assembly are manufactured from low-strength polymeric materials. The drum assembly collapses or fails immediately and typically cinches the lifeline upon sudden locking of the braking mechanism in the case of a fall, resulting (like other self-retracting lanyards) in sudden stoppage of lifeline extension and substantial stresses.

Because of the substantial stresses that can result during a fall, some mechanism or method is typically used to absorb at least some of the energy of the fall. For example, on some self-retracting lifelines, the web itself has extra convolutions or folds that are held together by stitching which tears out to absorb energy. Other self-retracting lifelines use friction brake mechanisms to absorb the energy. Many mechanisms and/or methods of energy absorption used in currently available self-retracting lifelines require additional parts or assembly steps during manufacture which add cost, bulk and/or complexity to the self-retracting lifelines.

It is thus desirable to develop systems, devices and methods that reduce or eliminate the above and/or other problems associated with currently available self-retracting lifeline systems.

SUMMARY OF THE INVENTION

In one aspect, the present invention provides a lifeline system including a lifeline and a hub around which the lifeline is coiled. The hub deforms to absorb energy at a predetermined level of force exerted thereon by the lifeline. For example, the hub can be deformable to absorb energy so that a peak fall arrest force in a drop test of the lifeline system with a 220 pound mass attached to the lifeline over a distance of up to 6.56 feet is not more than 1900 pounds. In several embodiments, the peak fall arrest force is no more than 1500 pounds or no more than 1349 pounds.

The lifeline system can further include a first component adjacent (for example, directly adjacent) the hub on a first side of the hub and a second component adjacent (for example, directly adjacent) the hub on the second side of the hub. The hub can be deformable to absorb energy generally independent of the first component and of the second component. That is, deformation of the hub occurs without significant or any deformation of the first component and the second component. In several embodiments, the hub is a component of a drum assembly including the hub and the first component, wherein the first component includes a first flange having a diameter greater than the hub. The hub can, for example, be attached to first flange via at least one connector. The drum assembly can further include the second component, which includes a second flange having a greater diameter than the hub. The hub can, for example, be attached to the second flange via at least one connector.

In several embodiments, the hub is of generally circular cross-section over at least a portion of a perimeter thereof. The drum assembly can be rotatable about an axis.

The system can further include a tensioning mechanism in operative connection with the hub/drum assembly to facilitate retraction of the lifeline.

The system can further include a braking mechanism in operative connection with the hub/drum assembly to stop rotation of the hub/drum assembly upon extension of the lifeline at a predetermined acceleration.

In several embodiments, the hub/drum assembly remains rotatable about the axis after deformation of the hub to absorb energy. The axis can, for example, be defined by a shaft passing through the hub/drum assembly.

The system can further include a housing at least partially enclosing the hub/drum assembly, the braking mechanism and the tensioning mechanism.

In a number of embodiments, the first flange and the second flange are connected to the hub via a generally central portion thereof which undergoes substantially no deformation. The hub can, for example, include a peripheral member about which the lifeline is coiled and at least one connecting member between the peripheral member and the generally central portion. At least a portion of the peripheral member and/or a portion of the connecting member are deformable to absorb energy.

In another aspect, the present invention provides a drum assembly for use in a lifeline system, including a hub and at least a first flange on a first side of the hub. The hub is deformable independent of the first flange to absorb energy at a determined level of force exerted thereon by a lifeline coiled around the hub so that a peak fall arrest force in a drop test of the lifeline system with a 220 pound mass attached to the lifeline over a distance of up to 6.56 feet is not more than 1900 pounds. The drum assembly can also include a second flange on a second side of the hub. The hub can, for example, be deformable independently of the first flange and of the second flange.

The first flange and the second flange can, for example, be connected to the hub via a radially inward or generally central portion thereof which undergoes substantially no deformation. The hub can, for example, include a peripheral member about which the lifeline is coiled and at least one connecting member between the peripheral member and the generally central portion. At least a portion of the peripheral member and/or a portion of the connecting member are deformable to absorb energy.

In another aspect, the present invention provides a method of absorbing energy in a lifeline system including: providing a hub as a first component of the lifeline system around which a lifeline is coiled. The hub is deformable to absorb energy at a determined level of force exerted thereon by the lifeline. The lifeline system can, for example, further include at least a second component adjacent (for example, directly adjacent) the hub on a first side of the hub and at least a third component adjacent (for example, directly adjacent) the hub on the second side of the hub. The hub is deformable independent of the second component and of the third component.

In another aspect, the present invention provides a lifeline system, including a lifeline and a hub around which the lifeline is coiled. The hub is deformable to absorb energy at a determined level of force exerted thereon by the lifeline so that a peak fall arrest force in a drop test of the lifeline system with a 220 pound mass attached to the lifeline is not more than 1900 pounds. The peak fall arrest force can also be no more than 1500 pound, no more than 1349 pounds, even no more than 1200 pounds or even no more than 1100 pounds.

In a further aspect, the present invention provides a lifeline, a hub around which the lifeline is coiled, a first component adjacent the hub on a first side of the hub; and a second component adjacent the hub on a second side of the hub. The hub is deformable to absorb energy at a determined level of force exerted thereon by the lifeline independent of the first component and of the second component.

The hub can, for example, be a component of a drum assembly including the hub, the first component and the second component. The first component can include a first flange having a diameter greater than the hub and the second component can include a second flange having a diameter greater than the hub. The hub can be attached to the first flange and the second flange via at least one connector. In several embodiments, the first flange and the second flange are connected to the hub via a generally central portion thereof which undergoes substantially no deformation.

As described above, the hub can be deformable to absorb energy so that a peak fall arrest force in a drop test of the lifeline system with a 220 pound mass attached to the lifeline over a distance of up to 6.56 feet is not more than 1900 pounds. In a number of embodiments, the peak fall arrest force is no more than 1500 pounds or no more than 1349 pounds.

In several embodiments, the self-retracting lifelines of the present invention thus include a component such as a hub which can deform to absorb energy. No extra components, extra parts or extra assembly steps are required to achieve such energy absorption. The self-retracting lifelines of the present invention can provide an increase in reliability as compared to certain currently available self-retracting lifelines while reducing complexity, bulk and/or cost.

The present invention, along with the attributes and attendant advantages thereof, will best be appreciated and understood in view of the following detailed description taken in conjunction with the accompanying drawings.

BRIEF DESCRIPTION OF THE DRAWINGS

FIG. 13A illustrates a front view of the drum assembly of FIG. 8 in an unstressed state wherein the screws and the hub flange are hidden.

FIG. 13B illustrates the drum assembly of FIG. 8, again, with the screws and the hub flange hidden, wherein the constricting effect of the web coils has caused the hub to deform.

DETAILED DESCRIPTION OF THE INVENTION

As used herein and in the appended claims, the singular forms "a," "an", and "the" include plural references unless the content clearly dictates otherwise. Thus, for example, reference to "a connector" includes a plurality of such connectors and equivalents thereof known to those skilled in the art, and so forth, and reference to "the connector" is a reference to one or more such connectors and equivalents thereof known to those skilled in the art, and so forth.

Figure 1:
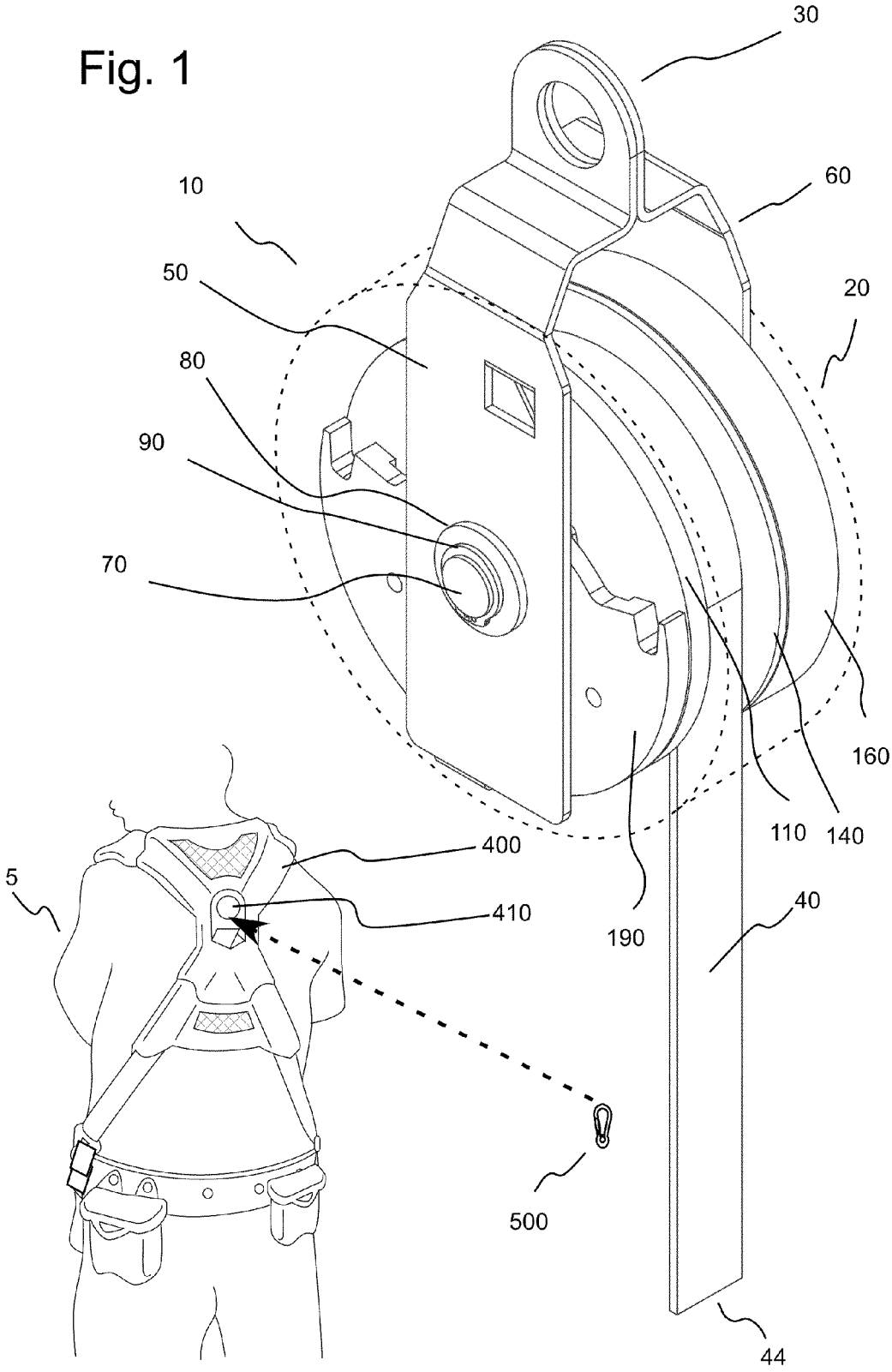
FIG. 1 illustrates a perspective view of an embodiment of a self-retracting lifeline system of the present invention wherein the outer housing is shown schematically in dashed lines.

FIG. 1 illustrates one embodiment of a self-retracting lifeline system 10 of the present invention wherein an outside cover or housing 20 is shown schematically in dashed lines. In several embodiments, cover 20 (which can, for example, be formed in two halves as known in the art) serves to protect internal mechanisms of self-retracting lifeline from damage, but otherwise does not significantly affect the operation of such internal mechanisms. In normal use, self-retracting lifeline system 10 can, for example, be connected via a connector 30 to some fixed object. A distal end 44 of lifeline 40 (for example, a polymeric web material as known in the art) can, for example, be connected to a harness 400 worn by the user 5 (see FIG. 1). Alternatively, connector 30 can be connected to the user (for example, to D-ring 410 via a snap ring or carabiner 500) and distal end 44 of lifeline 40 can be attached to some fixed object.

Figure 2:
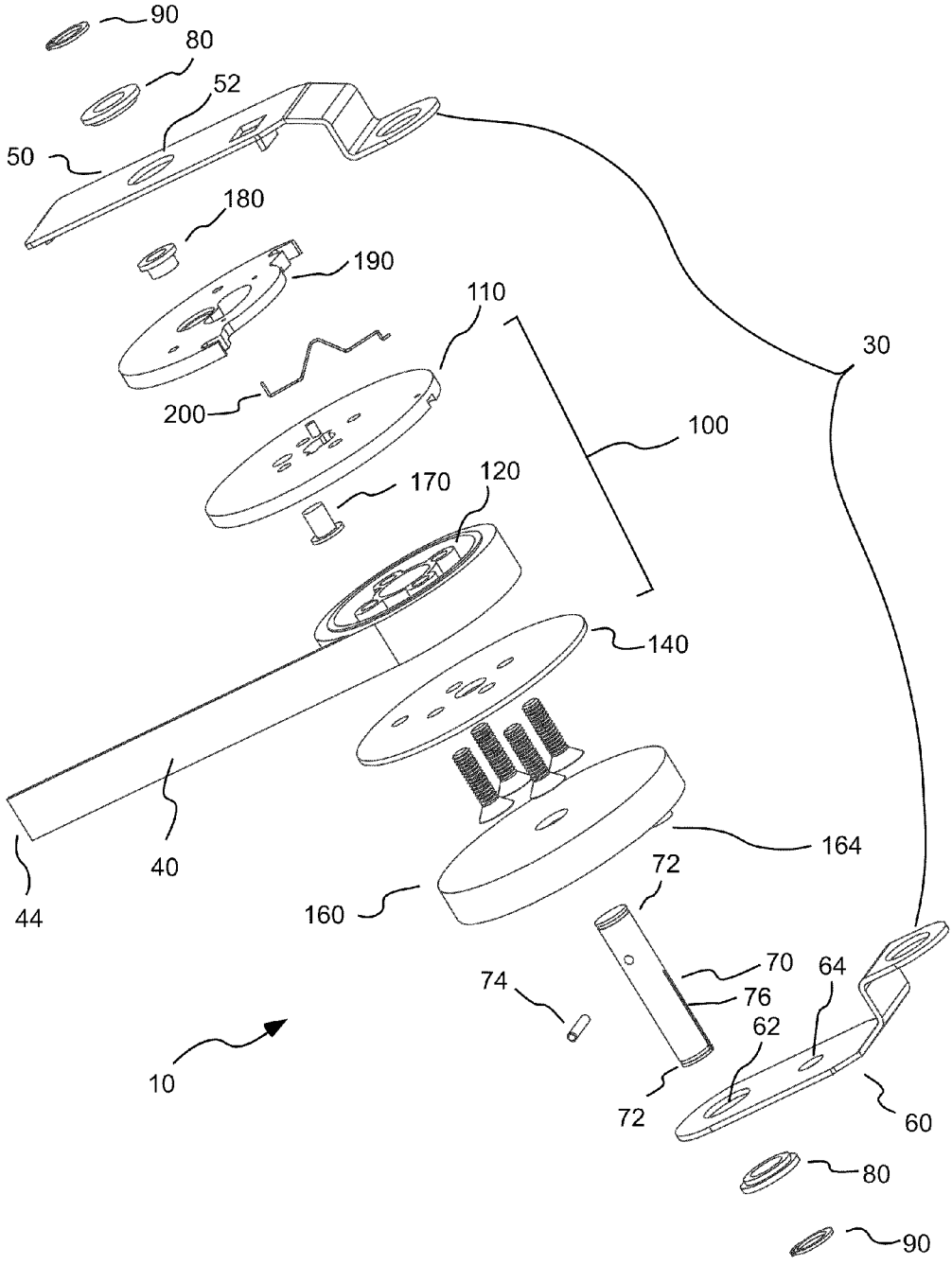
FIG. 2 illustrates an exploded or disassembled perspective view of the self-retracting lifeline system of FIG. 1.

FIG. 2 illustrates components of self-retracting lifeline system 10 in a disassembled state. Housing 20 is excluded in FIG. 2. A number of components rotate relative to frame members 50 and 60 about a shaft 70. In several embodiments, frame members 50 and 60 and shaft 70 were formed, for example, from a metal such as stainless steel. Shaft 70 rotates within shaft bushings 80 that are seated within holes 52 and 62 of frame members 50 and 60, respectively. Retainers such as snap rings 90 cooperate with seatings 72 formed within shaft 70 to retain shaft 70 in rotatable connection with bushings 80.

A hub or drum assembly 100 includes a first hub flange or plate 110, a hub or drum 120 around which lifeline web 40 is coiled, a web sleeve 130 (see, for example, FIG. 5), a second hub flange 140, and connectors such as screws 150. In several embodiments, hub plate 110 and hub flange 140 were formed from a metal such as aluminum or stainless steel, while hub or drum 120 was formed at least partially from a deformable material such as a polymeric material as described further below. When assembled, hub plate 110, hub 120, hub flange 140, and screws 150 form hub or drum assembly 100 which rotates on shaft 70. A loop end 42 of the lifeline web 40 surrounds web sleeve 130 (which is positioned with a passage 123 formed within hub 120; see, for example, FIG. 4) and shaft 70, thereby anchoring loop end 42 securely within drum assembly 100. In several embodiments, loop end 42 extends through a slot 121 formed in hub 120 (in connection or communication with passage 123; see, for example, FIGS. 5A-5D) and a portion of lifeline web 40 is coiled around hub 120, leaving a free end 44 which extends from housing 20 and attaches to the user through suitable hardware (for example, through an end connector as known in the art which cooperates with connector 500 and D-ring 410). Alternatively, free end 44 can attach to some fixed point while self-retracting lanyard system 10 is attached to the user as described above.

As common with self-retracting lifelines, tension can be applied to drum assembly 100 to retract lifeline 40 after extension thereof. In that regard, shaft 70 can be rotationally locked to hub plate 110 (which can also act as a catch or braking base as described below) by a shaft pin 74 which engages slots in hub plate 110. A power spring assembly 160 can include a conventional coiled strap of spring steel (not illustrated in detail in FIGS. 1 and 2) inside a plastic housing. One end of the spring steel strap can be anchored to housing 20. The other end can engage a slot 76 in shaft 70. The housing of power spring assembly 160 can be rotationally locked to frame 60 by a stud 164 on the housing engaging a hole 64 in frame 60. As described above, lifeline web 40 is anchored to and coiled around hub 120. At assembly, the power spring is "wound up" to provide torque to shaft 70 and thus to hub 120 or drum assembly 100. The torque applied to shaft 70 pre-tensions lifeline web 40 and causes lifeline web 40 to coil up or retract around hub 120 after it has been uncoiled therefrom (that is, pulled out or extended from housing 20).

Self-retracting lifeline system 10 can also include a braking mechanism as known in the art. In the illustrated embodiment, self-retracting lifeline system 10 includes a braking mechanism as described in copending U.S. Patent Application entitled SELF-RETRACTING LIFELINE SYSTEMS AND BRAKING SYSTEMS THEREFOR Ser. No. 12/392,061, filed Feb. 24, 2009, the disclosure of which is incorporated herein by reference. In that regard, a catch pivot 170 can be mounted in and extend through hub plate/catch base 110 to provide a pivot for a catch bushing 180 and a catch 190 (at a point in the vicinity of or at the center of mass of catch 190). The braking mechanism can also include a generally V-shaped catch spring 200 having one end which engages a hole in the hub plate/catch base 110 and another end which engages a hole in catch 190. As described in U.S. Patent Application entitled SELF-RETRACTING LIFELINE SYSTEMS AND BRAKING SYSTEMS THEREFOR, the force exerted by the catch spring 200 can be balanced against the rotational inertia of catch 190 so that catch 190 actuates to effect braking only when lifeline web 40 is being pulled from self-retracting lifeline system 10 at an acceleration rate corresponding to the beginning of a fall. For example, the catch/catch spring assembly can be designed to actuate when the web is being pulled out at ½ or ¾ times the acceleration of gravity. For lower accelerations or when the user is extending the web at a constant rate, such as when walking, hub assembly 100 turns freely.

FIGS. 3A through 7 illustrated details of one embodiment of hub or drum assembly 100 of the present invention. As clear to one skilled in the art, hub assembly 100 can be used in connection with many types of self-retracting lifeline systems. Self-retracting lifeline system 10 illustrated in FIGS. 1 and 2 is set forth as a representative example only. In FIGS. 3A through 7, the components of hub assembly 100 are set forth generically and may not include some of the specific elements described in connection with FIGS. 1 and 2 to operate in connection with self-retracting lifeline system 10.

Figure 3C:
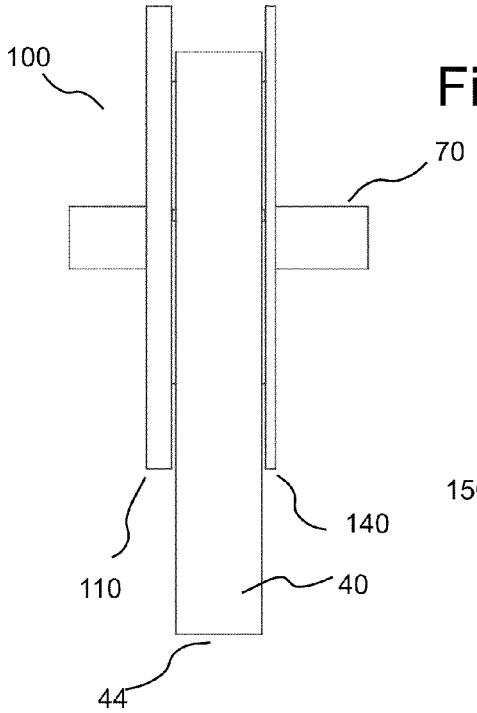
FIG. 3C illustrates a side view of the assembled drum assembly.
Figure 3B:
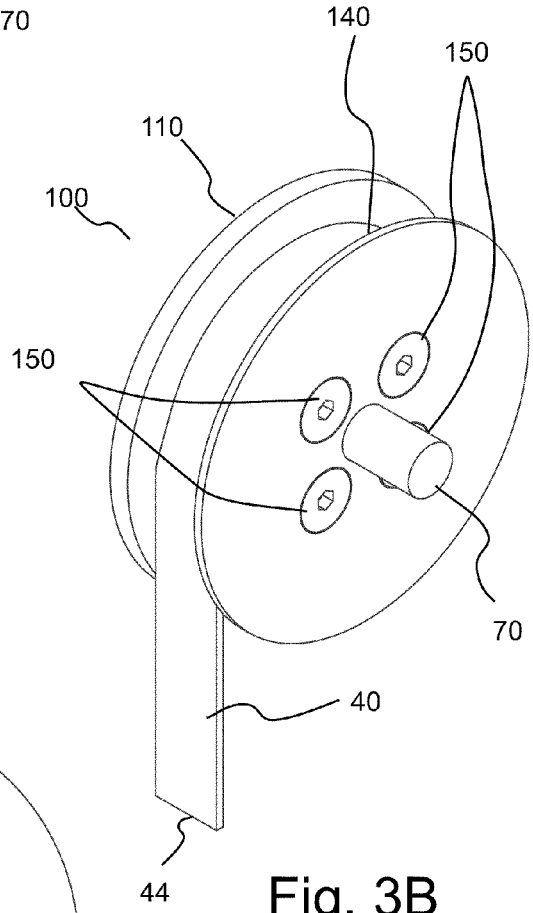
FIG. 3B illustrates a perspective view of the assembled drum assembly.
Figure 3A:
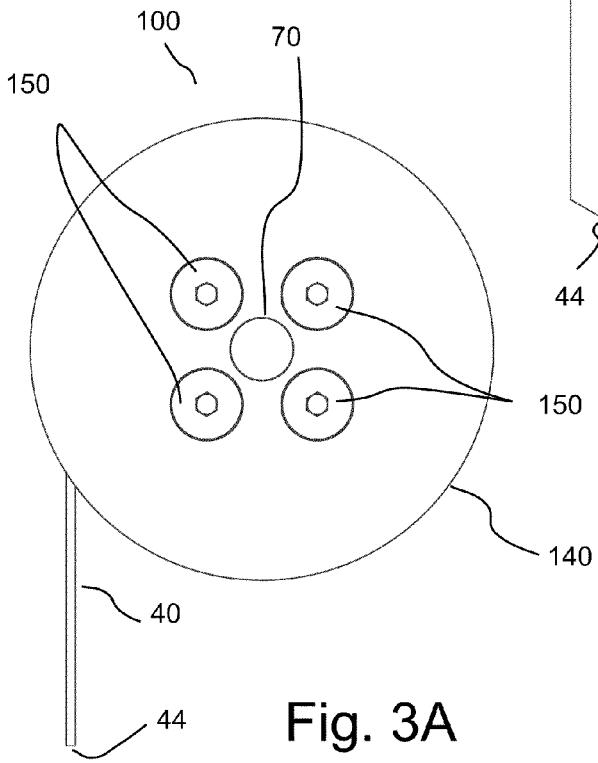
FIG. 3A illustrates a front view of an embodiment of an assembled drum assembly of the self-retracting lifeline system of FIG. 1.
Figure 4:
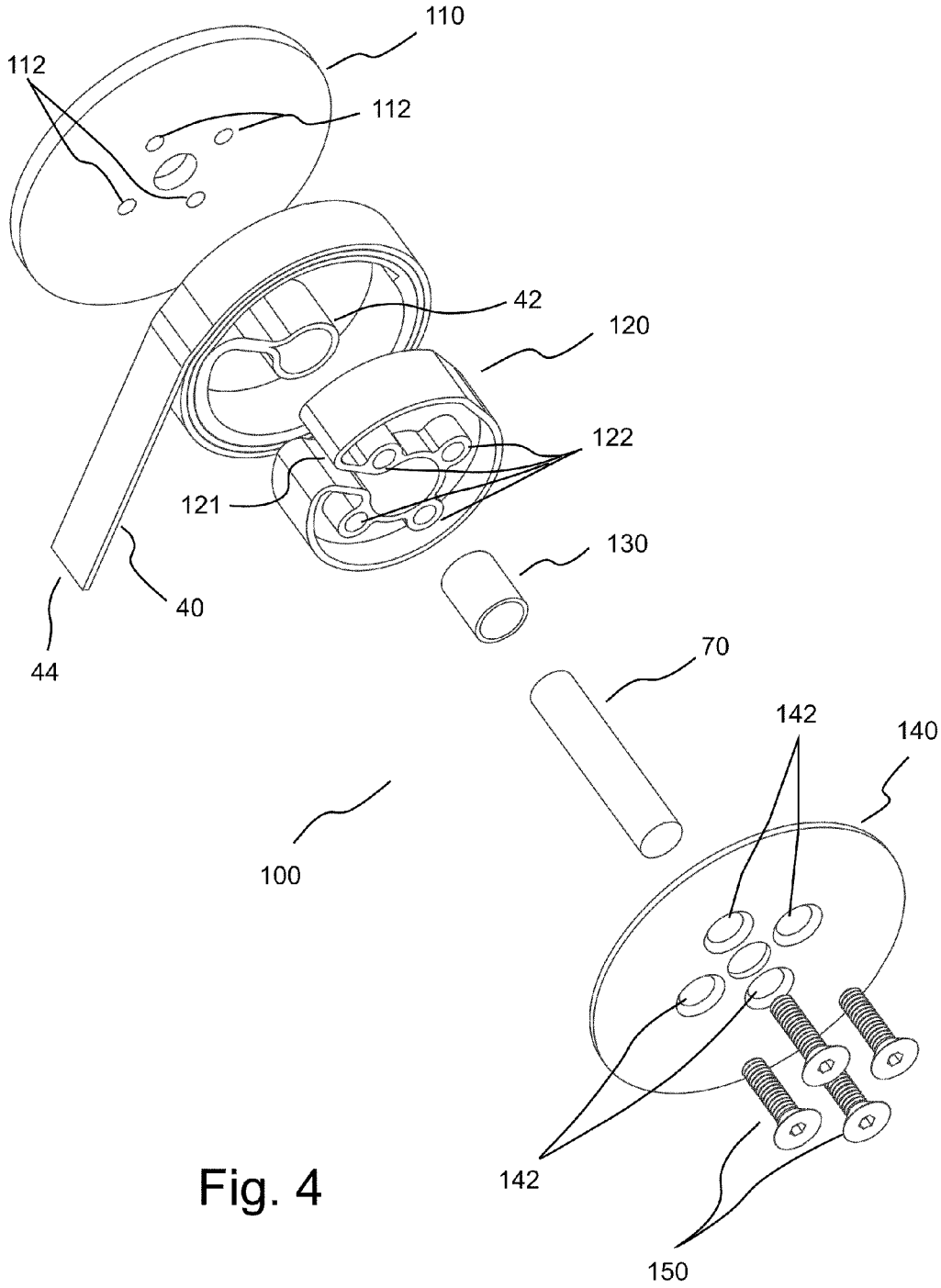
FIG. 4 illustrates an exploded or disassembled perspective view of the drum assembly.
Figure 5A:
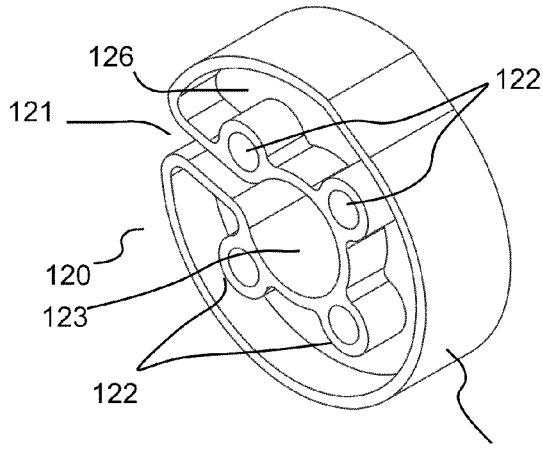
FIG. 5A illustrates a perspective view of an embodiment of a hub of the drum assembly of FIG. 3A.
Figure 5B:
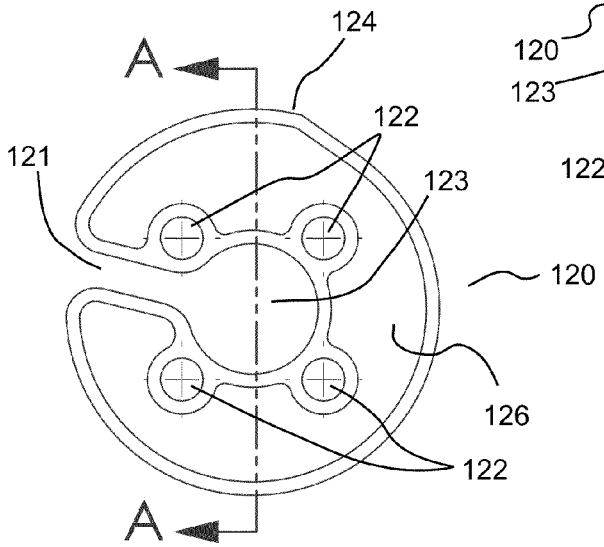
FIG. 5B illustrates a front view of the hub.
Figure 5D:
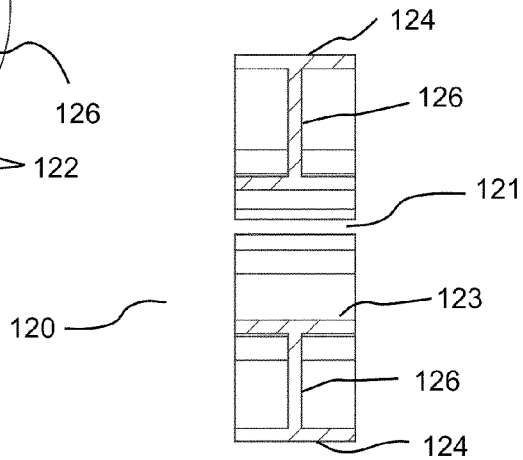
FIG. 5D illustrates a cross-sectional view of the hub along section A-A as set forth in FIG. 5B.
Figure 5C:
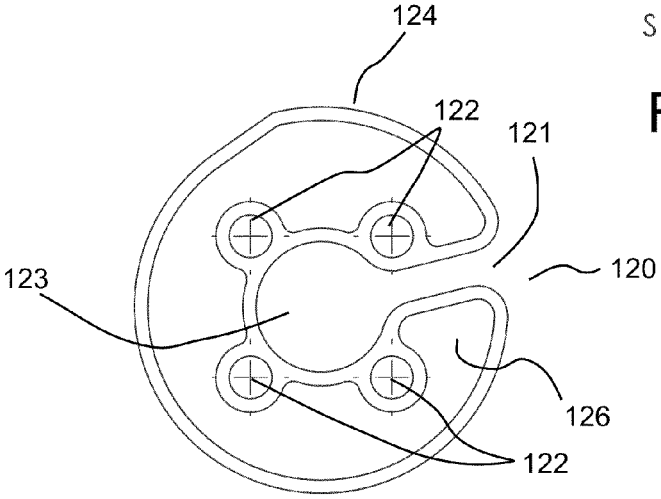
FIG. 5C illustrates a rear view of the hub.

FIGS. 3A through 3C illustrate drum assembly 100 in an assembled state, while FIG. 4 illustrates drum assembly 100 in a disassembled or exploded state. As described above, drum assembly 100 includes hub plate 110, hub or drum 120 around which lifeline web 40 is coiled, web sleeve 130 (see, for example, FIG. 4), hub flange 140, and connectors such as screws 150. As illustrated, for example, in FIG. 4, one or more connectors or screws 150 can be passed through passages 142 in hub flange 140, through passages 122 in hub 120 and through passages 112 in hub plate 110. At least passages 112 can, for example, include cooperating threading to retain screws 150 in operative connection therewith. As also described above, hub plate 110, hub 120, hub flange 140, and screws 150 form drum assembly 100, which rotates on shaft 70. Each of hub flange or plate 110 and hub flange 140 can, for example, have a radius/diameter larger than hub 120 to, for example, assist in or guide the coiling of lifeline web 40 around hub 120.

In FIG. 4, three complete coils or revolutions of lifeline web 40 around hub 120 are illustrated. However, the energy absorbing function of the hub or drum assemblies of the present invention will operate with more coils or as few as one coil. As described above a braking mechanism, when actuated, locks drum assembly 100 to prevent its rotation on shaft 70 in the event of a fall. After drum assembly 100 is locked, hub 120 can deform to absorb energy as described below.

FIG. 5A through 5D illustrate enlarged views of hub 120. Hub 120 (which can, for example, be molded from an integral piece of a polymeric material such as, for example, copolymer polypropylene) includes a peripheral or perimeter member 124, which forms the outer surface or perimeter of hub 120. Web lifeline 40 is coiled around peripheral or perimeter member 124 which facilitates smooth coiling and uncoiling of lifeline web 140 therearound when lifeline 40 extends and retracts during normal, non-locked use. In the illustrated embodiment, hub 120 also included an intermediate connector or septum 126 extending (for example, generally in the middle of hub 120) radially between peripheral member 124 and a shaft connecting or generally central portion of hub 120. The thickness of septum 126 assists in adjusting or determining the energy absorption afforded by hub 120 as described further below. In the illustrated embodiment, septum 126 is illustrated as a continuous member. However, one skilled in the art appreciates that septum 126 or another portion of a hub can be formed with voids to assist in adjusting energy absorption. The number, spacing and/or size of such voids can be varied to vary energy absorption. Likewise, a plurality of discrete or separate septums and/or other members can extend between peripheral member 124 and the shaft connecting or generally central portion of hub 120.

In several studied embodiments, hub 120 (which had a generally circular/cylindrical cross-section over most of the perimeter thereof) had a radius of approximately 1.18 inches. In the illustrated embodiment, peripheral member 124 included an area of non-circular cross-sectional shape to accommodate an area of the webbing of lifeline 40 which was doubled over on itself and stitched to create loop 42 (see, for example, FIG. 6) so that the outer coils of lifeline 40 around hub 120 would be of generally circular cross-sectional shape.

Figure 6:
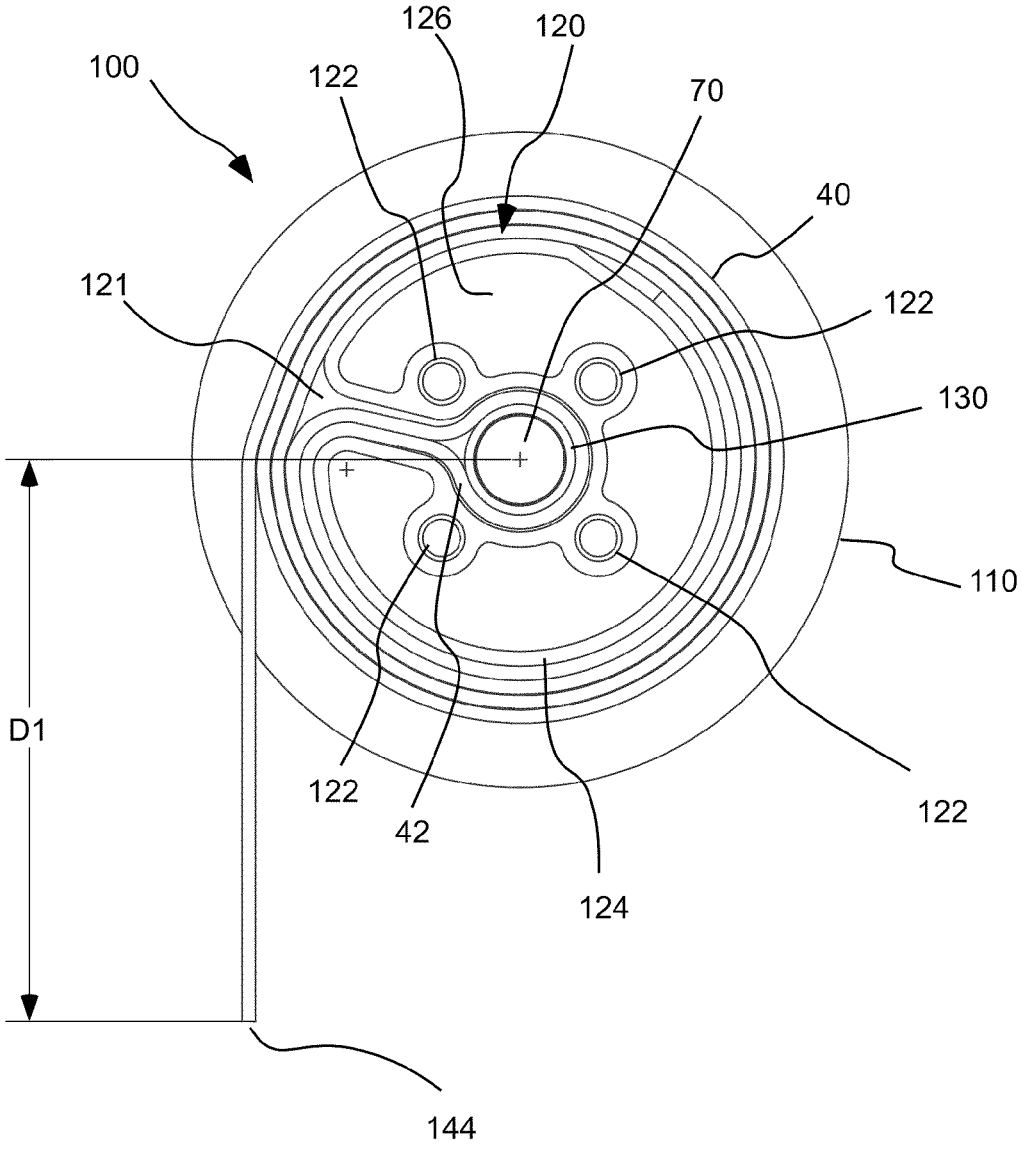
FIG. 6 illustrates a front view of the drum assembly in an unstressed state wherein the screws and the hub flange are hidden.

FIG. 6 illustrates drum assembly 100 with screws 150 and hub flange 140 hidden. It is assumed that just prior to drum assembly 100 locking, a weight (for example, 250 pounds corresponding to the weight of a user) attached to free end 44 of lifeline web 40 was in a nearly free-fall condition and had accumulated substantial kinetic energy. At the instant illustrated in FIG. 6, drum assembly 100 has locked and tension in lifeline web 40 is rapidly increasing, causing the coils of lifeline web 40 to constrict around hub 120. In the illustrated embodiment, at a certain tension level, determined, for example, in large part by the thickness (and/or other properties) of septum 126, hub 120 will begin to crush as a result of the radial forces acting upon it.

Figure 7:
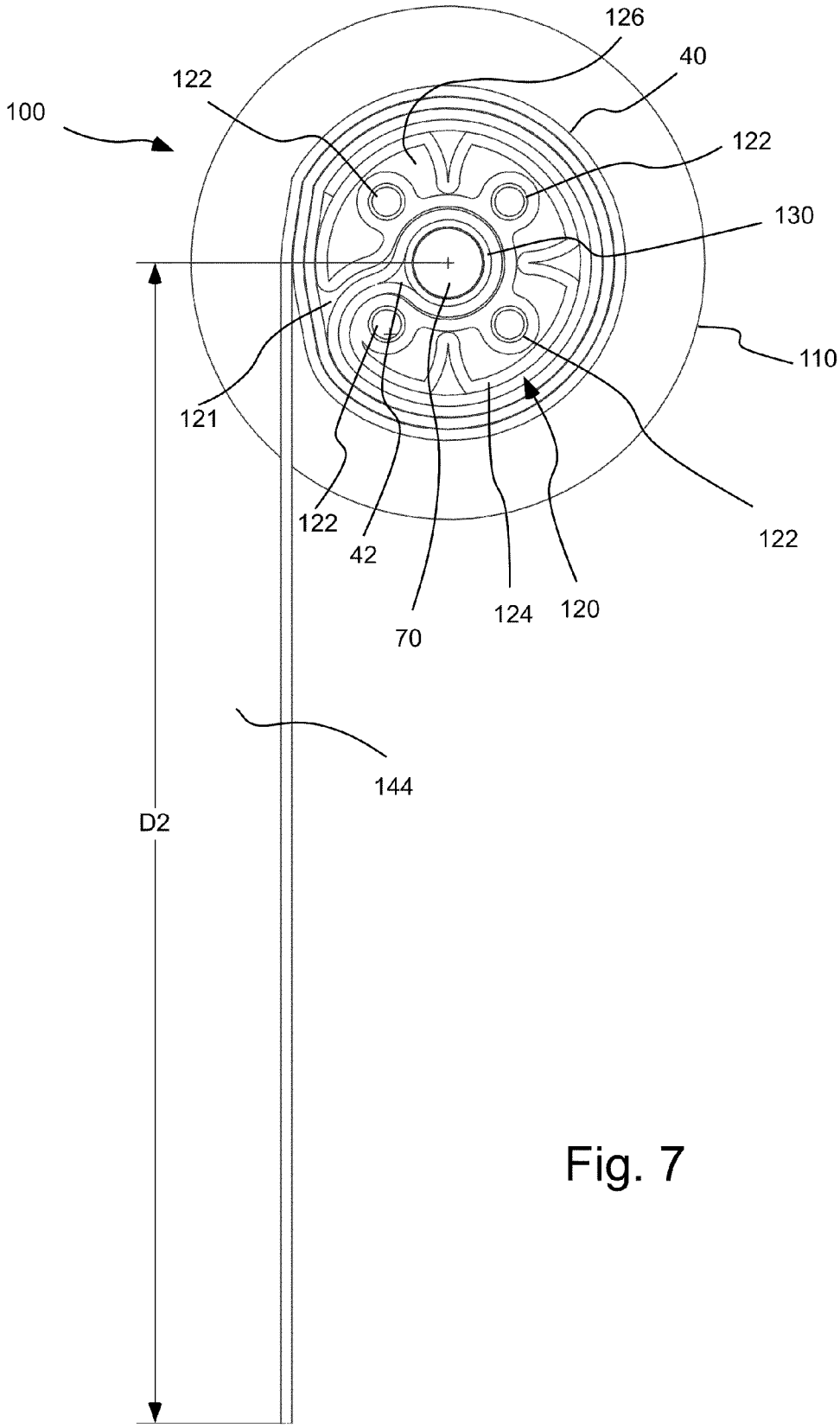
FIG. 7 illustrates the drum assembly, again, with the screws and the hub flange hidden, wherein the constricting effect of the web coils has caused the hub to deform.

FIG. 7 illustrates drum assembly 100, once again, with screws 150 and hub flange 140 hidden. As a result of the constricting effect of the lifeline web coils, hub 120 has deformed (for example, reduced in outside diameter). The deformed hub shape illustrated is an approximation. Forces on septum 126 have caused it to deform (variously buckle, compress, or stretch, depending on the region of hub 120). Outside peripheral member 124 has also deformed (for example, buckled and folded) as a result of the reduction of perimeter. The net effect of the deformation (buckling, compressing, etc.) is that kinetic energy is absorbed as the falling weight was gradually brought to a halt. In comparison of FIGS. 6 and 7, free end 44 of lifeline web 40 (to which the weight is attached) has moved down from a point D1 (see FIG. 6) to a point D2 (see FIG. 7). In one study, D1 was approximately 3.0 inches and D2 was approximately 7.9 inches. Thus, lifeline web end was 7.9-3.0 or 4.9 inches lower than its starting position. If plotted, the area under the curve of web tension versus the free end displacement would equal the total energy absorbed.

The number of coils of web lifeline 40 around hub 120 affects the displacement and the maximum web tension. In that regard, if there were more web coils on hub 120, the maximum web tension would be less but the displacement would be greater, yielding roughly the same energy absorption. Further, fewer coils would produce a greater maximum web tension while having less displacement, again, with roughly the same energy absorption.

Hub 120 will provide energy absorption as described above if the falling weight is attached to distal end 44 of web lifeline 40 as well as if distal end 44 of web lifeline 40 is attached to a fixed object/anchor point. Furthermore, it is also understood that energy absorbing hub 120 will also operate to absorb energy if a rope, a cable or other extending member is used for the lifeline rather than a web material as described herein as a representative example.

In several embodiments, at least a portion of hub 120 is formed from a deformable material that deforms to absorb energy. As describe above, hub 120 can include septum 126 having a thickness that can be adjusted to fine tune energy absorption. In that regard, for a particularly case, if septum 126 is too thin, the force required to crush it will be too small, resulting in too little energy absorption. If, for a particular case, septum 126 is too thick, the force required to crush it will be too great, and again the resultant energy absorption will be too small. One skilled in the art can readily establish a proper thickness for to achieve desired energy absorption using established engineering principles and methodologies. As clear to one skilled in the art, many other hub configurations can also be used. Non-elastic deformation of a material (for example, via crushing of a polymeric or metallic hub member of a drum assembly) is one example of an energy absorption methodology. Energy absorption via an elastic deformation or a combination of elastic and non-elastic deformation is also possible.

In the illustrated embodiments, hub 120 deforms under, for example, the tensions/forces experienced upon braking in a fall as described above. However, hub plate 110 (a first lateral flange) and hub flange 140 (a second lateral flange), as well as other components of system 10 exhibit little or no deformation under such tensions. In the illustrated embodiment, hub 120 is attached to hub plate 110 and hub flange 140 so that hub 120 can deform independently of any deformation of hub plate 110 and hub flange 140. As clear to one skilled in the art, in alternative embodiments, hub plate 110 and hub flange 140 and/or other components of self-retracting lifeline system 10 need not be connected to hub 120 or in locked, rotating connection with shaft 70. Should one or more of the components of system 10 or of an alternative embodiment on either side of hub 120 deform, it is, for example, possible that cinching of lifeline web 40 can occur (thereby stopping extension of lifeline web 40) or another interfering interaction can occur before substantial or even any energy absorption can occur via deformation of hub 120. Moreover, operation of horizontal lifeline system 10 can otherwise be compromised if components other than hub 120 are caused to deform.

In a number of embodiments, drum assembly 100 remains rotatable about shaft 70 and can, for example, still operate to retract lifeline web 40 upon removable of extending force thereon) even after a fall and the associated deformation of hub 120 in accordance, for example, with the ANSI Z359.1 Standard and the Canadian Standards Association (CSA) Z259.2.2 Standard, the disclosures of which are incorporated herein by reference. For example, at least a portion of septum 126 and a portion of peripheral member 124 can deform, while a generally central portion or flange connecting portion of hub 120 around passage 123 remains substantially or completely undeformed to facilitate rotation of hub or drum assembly 100 with shaft 70 after deformation of radially outward portions of hub 120 (without deformation of adjacent components such as hub plate 110 and hub flange 120). The central portion of hub 120 can, for example, be strengthened via, for example, increased material thickness or other structural techniques as known in the art. The central portion of hub 120 can also be formed of a material different from (for example, stronger than) the deforming portion of hub 120.

In the illustrated embodiment, for example, the periphery of passages 122 and passage 123 are formed to have increased thickness such that generally no deformation of the central portion of hub 120 occurs. As hub plate 110 and hub flange 140 are in operative connection with the central portion of hub 120 (via passages 122 and screws 150), little or no force tending to deform hub plate 110 or hub flange 140 are transferred to hub plate 110 or hub flange 140. Hub plate 110 and hub flange 140 can, for example, be formed of a polymeric material or of a metal material.

Figure 8:
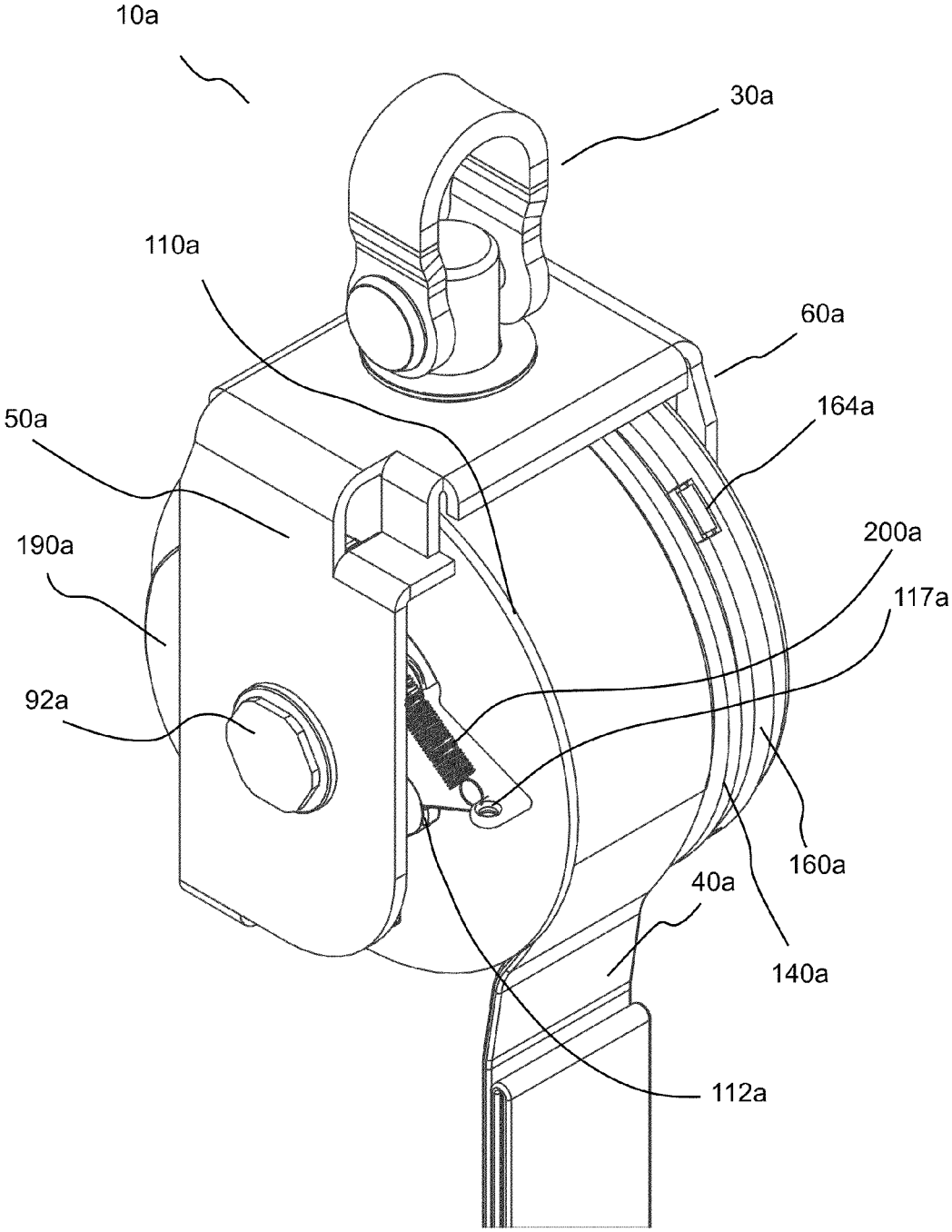
FIG. 8 illustrates a perspective view of another embodiment of a self-retracting lifeline system of the present invention from which the outer housing has been removed.
Figure 9:
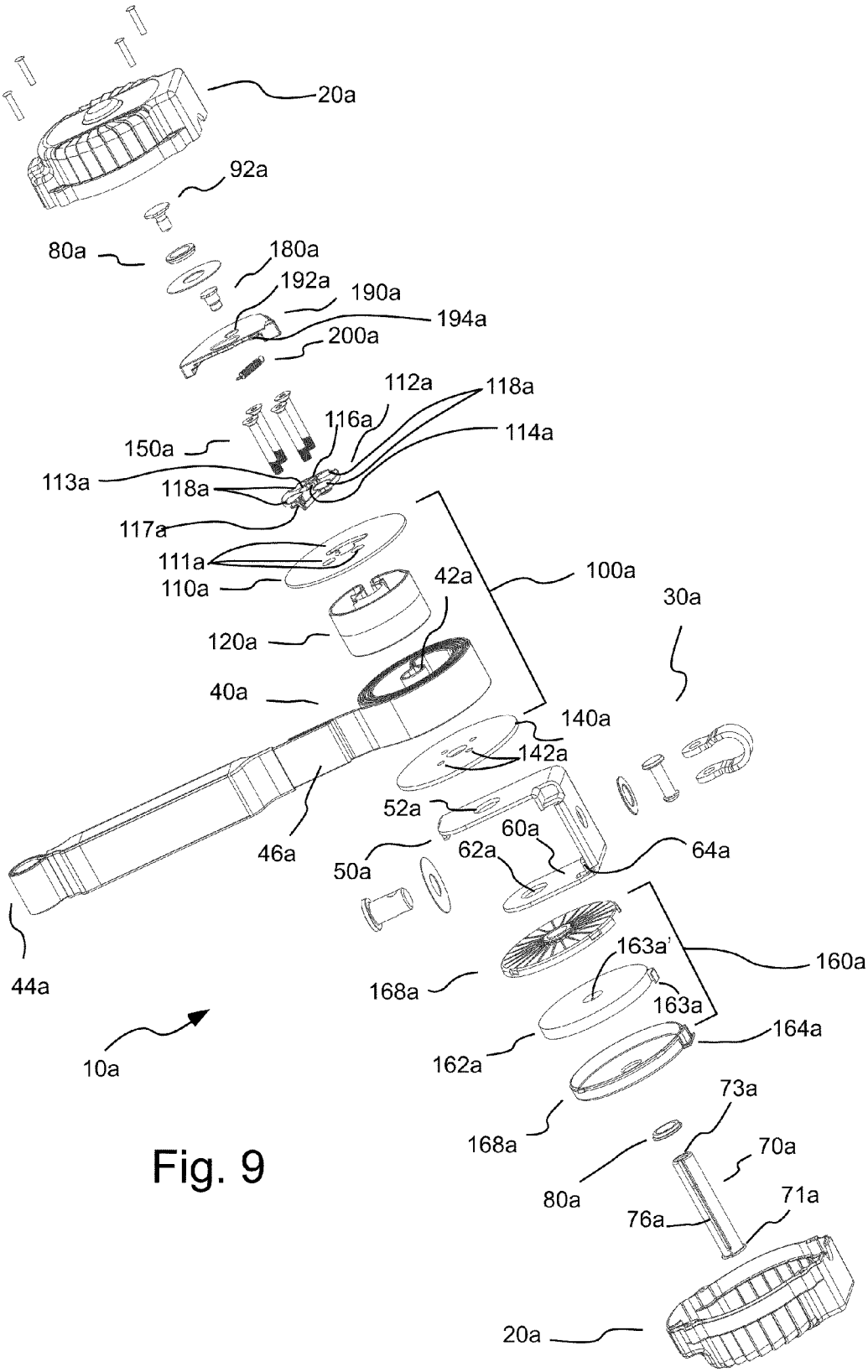
FIG. 9 illustrates an exploded or disassembled perspective view of the self-retracting lifeline system of FIG. 8.
Figure 10C:
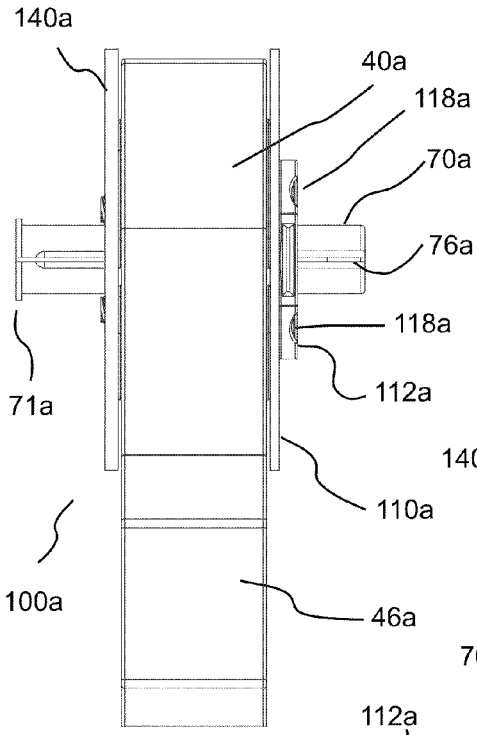
FIG. 10C illustrates a side view of the assembled drum assembly of FIG. 8.
Figure 10B:
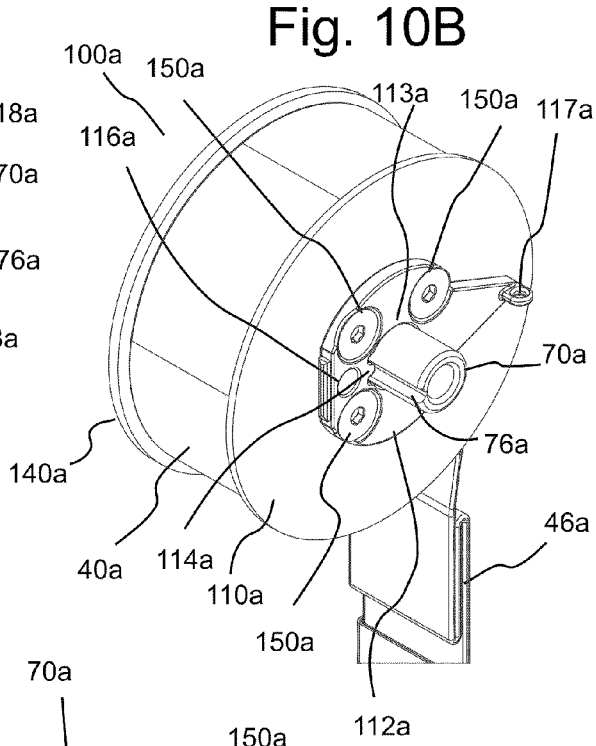
FIG. 10B illustrates a perspective view of the assembled drum assembly of FIG. 8.
Figure 10A:
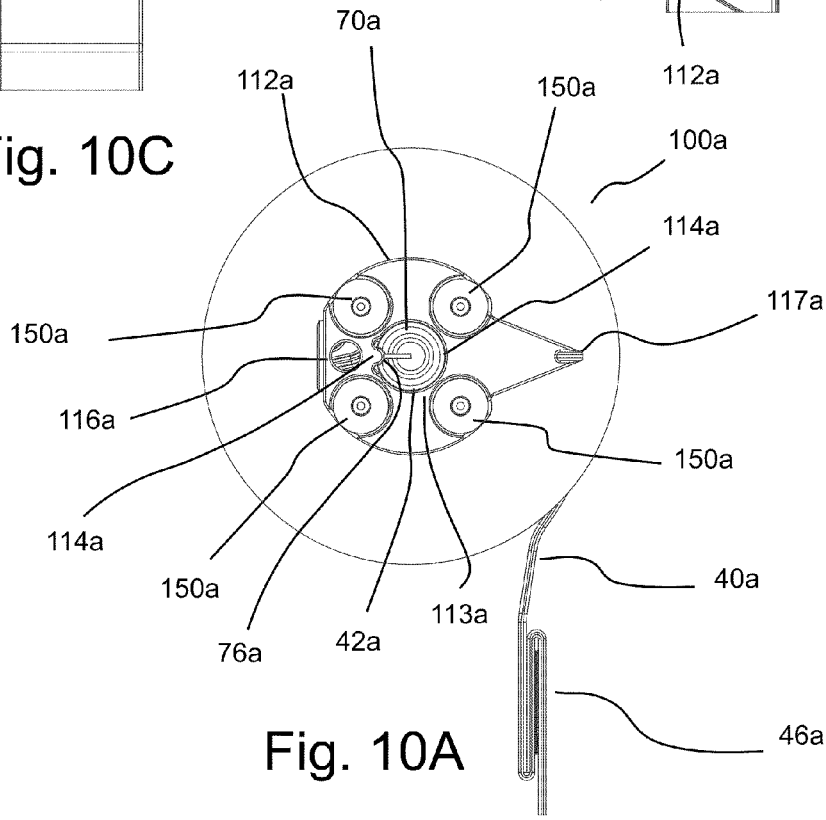
FIG. 10A illustrates a front view of an embodiment of an assembled drum assembly of the self-retracting lifeline system of FIG. 8.
Figure 11:
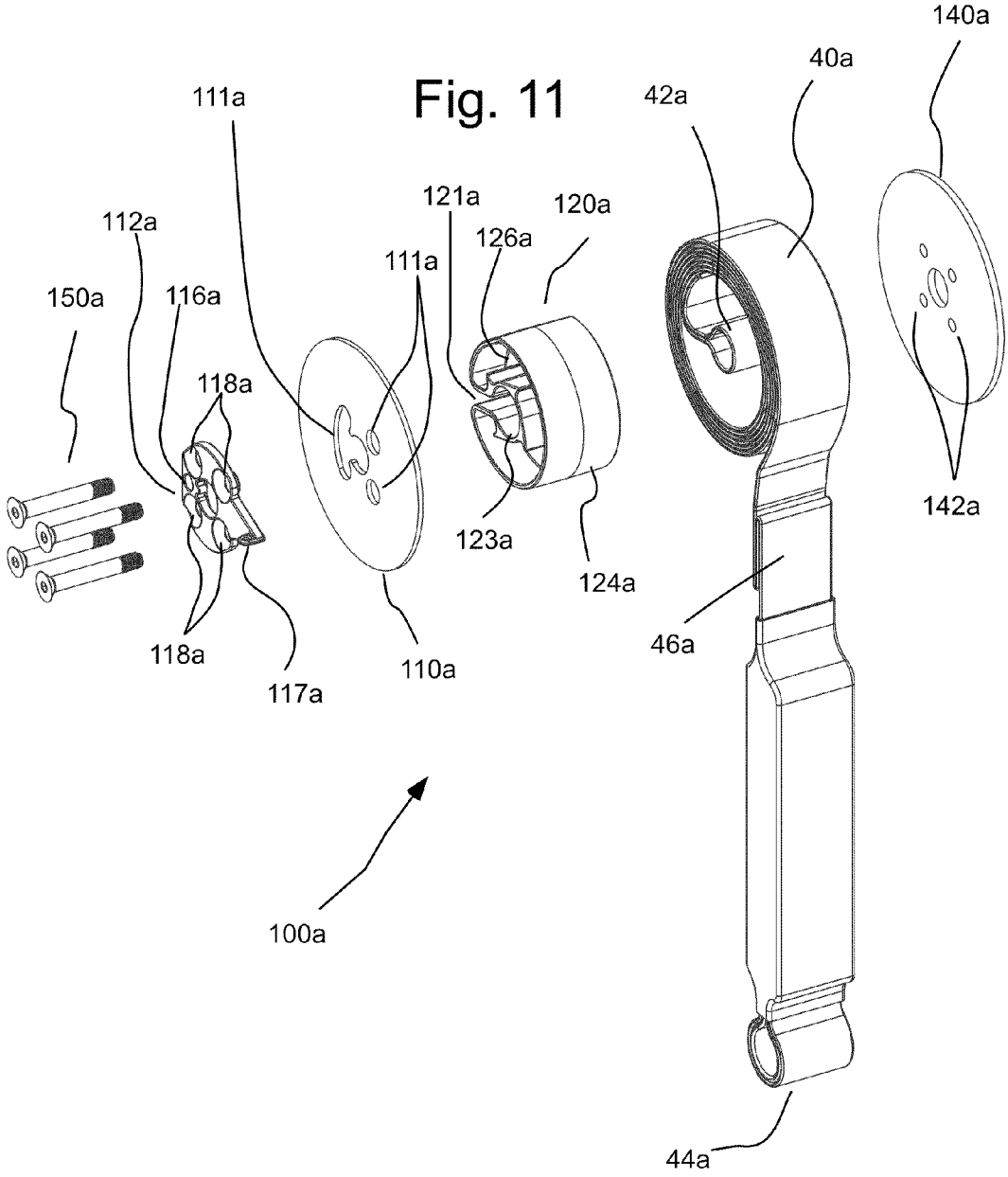
FIG. 11 illustrates an exploded or disassembled perspective view of the drum assembly of FIG. 8.
Figure 12B:
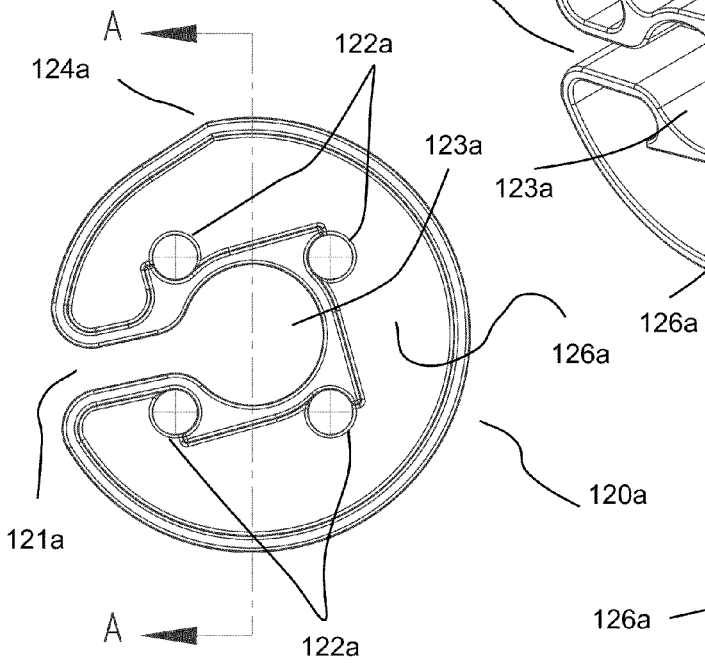
FIG. 12B illustrates a front view of the hub of FIG. 12A.
Figure 12A:
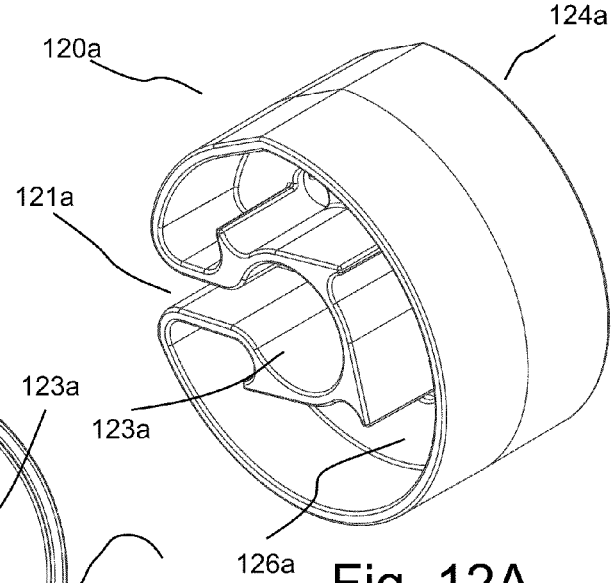
FIG. 12A illustrates a perspective view of an embodiment of a hub of the drum assembly of FIG. 10A.
Figure 12D:
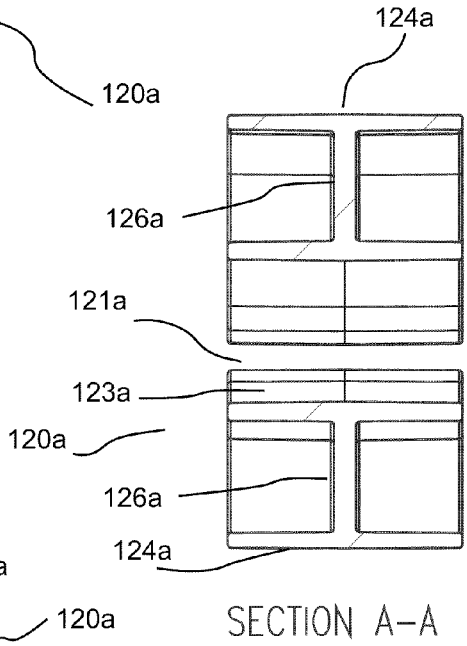
FIG. 12D illustrates a cross-sectional view of the hub along section A-A as set forth in FIG. 12B.
Figure 12C:
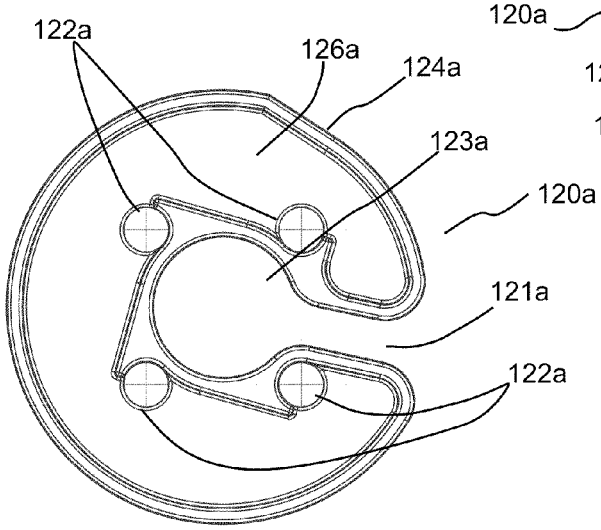
FIG. 12C illustrates a rear view of the hub of FIG. 12A.

FIGS. 8 through 13B illustrates another embodiment of a self-retracting lifeline system 10*a* of the present invention which operates in a similar manner to self-retracting lifeline system 10. In FIGS. 8 though 13B, like elements of system 10*a* are designated similarly to corresponding elements of system 10 with the addition of the designation "a" thereto. As illustrated in FIG. 9, a cover is formed via connection of two housing members 20*a* and serves to protect internal mechanisms of self-retracting lifeline 10*a* from damage. Self-retracting lifeline 10*a* can, for example, be connected via a connector 30*a* to some fixed object. A distal end 44*a* of lifeline 40 (for example, a polymeric web material as known in the art) can, for example, be connected to a harness 400 worn by the user 5 (see FIG. 1). Alternatively, connector 30*a* can be connected to the user (for example, to D-ring 410 via a snap ring or carabiner 500) and distal end 44*a* of lifeline 40*a* can be attached to some fixed object.

FIG. 9 illustrates components of self-retracting lifeline system 10*a* in a disassembled or exploded state. As described in connection with system 10, a number of components of system 10*a* rotate relative to frame members 50*a* and 60*a* about a shaft 70*a*. In the embodiment of FIGS. 8 through 13B, frame members 50*a* and 60*a* are formed integrally as part of a U-shaped length of metal (for example, stainless steel). Shaft 70*a* (formed, for example, from a metal such as stainless steel) rotates within bushings 80*a* positioned with passages 52*a* and 62*a* of frame members 50*a* and 60*a*, respectively. A flanged retainer such as a threaded member 92*a* cooperates with a threaded passage 73*a* formed in one end of shaft 70*a* to retain shaft 70*a* in rotatable connection with frame members 50*a* and 60*a*. A flange 71*a* on the other end of shaft 70*a* can, for example, abut frame member 60*a*.

Hub or drum assembly 100*a* of system 10*a* includes a first hub flange or hub plate 110*a*, a hub or drum 120*a* around which lifeline web 40*a* is coiled, a second hub flange 140*a*, and connectors such as screws 150*a* (which are oriented in the opposite direction as screws 150 of system 10). In several embodiment, hub plate 110*a* and hub flange 140*a* were formed from a metal such as aluminum or stainless steel, while hub 120*a* was formed from a deformable polymeric material as described above. When assembled, hub plate 110*a*, hub 120*a*, hub flange 140*a*, and screws 150*a* form hub or drum assembly 100*a* which rotates on shaft 70*a*. Hub 120*a* is of decreased diameter and increased width as compared to hub 120 to accommodate a lifeline web that is approximately 25 mm wide (as compared to hub 120*a*, which is designed for use with webbing that is approximately 17 mm wide). A loop end 42*a* of the lifeline is positioned with a passage 123*a* (see, for example, FIGS. 12A-12D) formed within hub 120*a* around shaft 70*a* to anchor loop end 42*a* securely within drum assembly 100*a*. Loop end 42*a* extends through a slot 121*a* formed in hub 120*a* and a portion of lifeline web 40*a* is coiled around hub 120*a*, leaving a free end 44*a* which extends from housing 20. Lifeline web 40*a* also includes an energy absorbing portion or section 46*a* in which, for example, a length of lifeline web 40*a* is folded back upon itself and sewn or stitched together as know in the fall protection arts. In the case of a fall, the stitching of the energy absorbing portion 46*a* tears to absorb energy.

Shaft 70*a* is rotationally locked to hub plate 110 via a catch or braking base 112*a* (formed, for example, from a metal such as case stainless steel) that is connected to hub plate 110*a* by screws 150*a*. In that regard, braking base 112*a* includes a passage 113*a* formed therein through which shaft 70*a* passes and a radially inward projecting member 114*a* which engages a radially outward portion of slot 76*a* of hub plate 110. Tension is applied to drum assembly 100*a* to retract lifeline 40*a* after extension thereof via a power spring assembly 160*a* including coiled strap of spring steel 162*a* inside a plastic housing formed by housing members 168*a*. A radially outward end 163*a* of spring steel strap can be anchored to frame 60*a*. A radially inward end 163*a*' can engage a radially inward, narrow portion of slot 76*a* in shaft 70*a*. One housing member 168*a* of power spring assembly 160 can, for example, be rotationally locked to frame 60 by a projecting member or stud 164*a* on housing member 168*a* which engages an abutment member 64*a* formed in frame 60*a*. As described above, lifeline web 40*a* is anchored to and coiled around hub 120*a* of drum assembly 100*a*. At assembly, power spring 162*a* is "wound up" to provide torque to shaft 70*a* and thus to drum assembly 100*a*. The torque applied to shaft 70*a* pre-tensions lifeline web 40 and causes lifeline web 40 to coil up or retract around hub 120*a* after it has been uncoiled therefrom as described above in connection with self-retracting lanyard system 10.

Self-retracting lifeline system 10*a* also includes a braking mechanism. Like self-retracting lifeline system 10, self-retracting lifeline system 10*a* can, for example, include a braking mechanism as described in copending U.S. Provisional Patent Application Ser. Nos. 61/031,336 and 61/045,808. In that regard, a catch 190*a* (formed, for example, from a metal such as cast stainless steel) is pivotably or rotatably mounted (eccentric to the axis of shaft 70*a*) to catch base 112*a* via a partially threaded pivot member 180*a* which passes through a passage 192*a* formed in catch 190*a* to connect to a threaded passage 116*a* on catch base 110*a*. The axis of threaded pivot member 180*a* (and passage 192*a*) preferably corresponds approximately or generally to the center of mass of catch 190*a*. In that regard, pivot member is preferably positioned in the vicinity of the center of mass of catch 190*a* and preferably as close to the center of mass as possible. The braking mechanism can also include a catch spring 200 having one end which engages a connector 117*a* (for example, a loop or passage) of catch base 112*a* and another end which engages a connector 194*a* (for example, a loop or passage) of catch 190*a*. The force exerted by the catch spring 200*a* is generally balanced against the rotational inertia of catch 190*a* so that catch 190*a* actuates (via centrifugal force) to effect braking only when lifeline web 40*a* is being pulled from self-retracting lifeline system 10*a* at an acceleration rate corresponding, for example, to the beginning of a fall as described above in connection with system 10.

FIGS. 10A through 13 illustrated details hub or drum assembly 100*a*. Like drum assembly 100, drum assembly 100*a* can be used in connection with many types of self-retracting lifeline systems. Screws 150*a* are passed through passages 118*a* in catch base 112*a*, passages 111*a* hub plate 10*a*, through passages 122*a* in hub 120*a* and through passages 142*a* in hub flange 140*a* to retain drum assembly 100*a* and catch base 112*a* in operative connection.

As described in connection with hub 120, hub 120*a* can, for example, be molded from an integral piece of a polymeric material such as, for example, copolymer polypropylene. Hub 120*a* includes a peripheral or perimeter member 124*a* which forms the outer surface or perimeter of hub 120*a*. Web lifeline 40 is coiled around peripheral or perimeter member 124*a* which facilitates smooth coiling and uncoiling of lifeline web 140*a* therearound when lifeline 40*a* extends and retracts during normal, non-locked use. As also described in connection with hub 120, hub 120*a* also included an intermediate connector such as a septum 126*a* extending between peripheral member 124*a* and a radially inward or generally central portion of hub 120*a*. Once again, the thickness (and/or other properties) of septum 126*a* assists in adjusting or determining the energy absorption afforded by hub 120*a* as described in connection with hub 120.

FIG. 13A illustrates drum assembly 100*a* with screws 150*a* and hub flange 140*a* hidden. It is assumed that just prior to drum assembly 100*a* locking, a weight (for example, 250 pounds corresponding to the weight of a user) attached to free end 44*a* of lifeline web 40*a* was in a nearly free-fall condition and had accumulated substantial kinetic energy. At the instant illustrated in FIG. 13A, drum assembly 100*a* has locked and tension in lifeline web 40*a* is rapidly increasing, causing the coils of lifeline web 40*a* to constrict around hub 120*a*. At a certain tension level, determined, for example, in large part by the thickness of septum 126*a*, hub 120*a* will begin to crush as a result of the radial forces acting upon it (see FIG. 13B). Comparison of FIGS. 13A and 13B illustrates the deformation of hub 120*a* to absorb energy in a manner similar to that described in connection with hub 120. As also described in connection with hub 120, a generally central portion or flange connecting portion of hub 120*a* around passage 123 remains substantially or completely undeformed to facilitate rotation of hub or drum assembly 100*a* after energy absorbing deformation of at least a portion of hub 120*a*.

Figure 14:
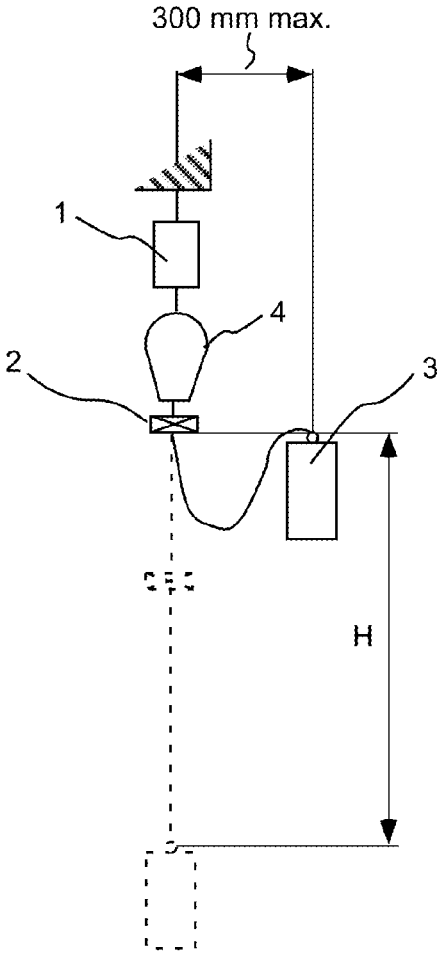
FIG. 14 sets forth CEN standards EN 360: 1992 and 2002 and EN 364: 1992 and 1993.

In several studies of the present invention, systems 10 and 10*a* were submitted to a drop test as set forth in CEN (European Committee for Standardization) standards EN 360: 1992 and 2002 and EN 364: 1991 and 1993, in the disclosures of which are incorporated herein by reference. A diagram of the testing system is set forth in FIG. 14. In FIG. 14, a force measuring instrument 1 is used to measure a force resulting from a free drop of a mass 3 of 100 kg. In several studies, self-retracting lifeline systems 4 were subjected to a drop a distance H (not exceeding 2 m or approximately 6.56 feet; as measured from a clip or connector mechanism 2 attaching mass 4 to self-retracting lifeline system 4) with 100 kg (approximately 220 pounds) mass 3 as provided in the standards. The resulting peak fall arrest force (PFAF) or braking force was approximately 1,100 pounds, which is less than the limit of 1,349 pounds (6 kN) set forth in EN 364.

The foregoing description and accompanying drawings set forth the preferred embodiments of the invention at the present time. Various modifications, additions and alternative designs will, of course, become apparent to those skilled in the art in light of the foregoing teachings without departing from the scope of the invention. The scope of the invention is indicated by the following claims rather than by the foregoing description. All changes and variations that fall within the meaning and range of equivalency of the claims are to be embraced within their scope.

What is claimed is:

1. A lifeline system, comprising:

a lifeline; and a hub around which the lifeline is coiled, the hub being deformable to absorb energy at a determined level of force exerted thereon by the lifeline so that a peak fall arrest force in a drop test of the lifeline system with a 220 pound mass attached to the lifeline over a distance of up to 6.56 feet is not more than 1900 pounds, wherein the hub comprises a peripheral member about which the lifeline is coiled and at least one annular connecting member extending between the peripheral member and a generally central portion of the hub, at least a portion of the peripheral member and the connecting member being deformable to absorb energy in response to force exerted thereon by the lifeline, the connecting member extending axially along the hub a distance less than an axial length of the hub, wherein the annular connecting member is a disc.

2. The system of claim 1 wherein the peak fall arrest force is no more than 1500 pounds.

3. The system of claim 1 wherein the peak fall arrest force is no more than 1349 pounds.

4. The lifeline system of claim 1 further comprising a first component adjacent the hub on a first side of the hub and a second component adjacent the hub on a second side of the hub, the hub being deformable independent of the first component and of the second component.

5. The system of claim 4 wherein the hub is a component of a drum assembly comprising the hub and the first component, wherein the first component comprises a first flange having a diameter greater than the hub.

6. The system of claim 5 wherein the hub is attached to the first flange via at least one connector.

7. The systemof claim 6 wherein the drum assembly further comprises the second component, wherein the second component comprises a second flange having a diameter greater than the hub.

8. The system of claim 7 wherein the hub is attached to the second flange via at least one connector.

9. The system of claim 8 wherein the hub is of generally circular cross-section over at least a portion thereof.

10. The system of claim 9 wherein the drum assembly is rotatable about an axis.

11. The system of claim 10 further comprising a tensioning mechanism in operative connection with the drum assembly to facilitate retraction of the lifeline.

12. The system of claim 11 further comprising a braking mechanism in operative connection with the drum assembly to stop rotation of the drum assembly upon extension of the lifeline at a predetermined acceleration.

13. The system of claim 10 wherein the drum assembly remains rotatable about the axis after deformation of the hub to absorb energy.

14. The system of claim 13 wherein the axis is defined by a shaft passing through the drum assembly.

15. The system of claim 13 further comprising a housing at least partially enclosing the drum assembly, the braking mechanism and the tensioning mechanism.

16. The system of claim 8 wherein the first flange and the second flange are connected to the hub via the generally central portion thereof which undergoes substantially no deformation.

17. A lifeline system, comprising:

a lifeline; and a hub around which the lifeline is coiled, the hub being deformable to absorb energy at a determined level of force exerted thereon by the lifeline so that a peak fall arrest force in a drop test of the lifeline system with a 220 pound mass attached to the lifeline over a distance of up to 6.56 feet is not more than 1900 pounds, a first component adjacent the hub on a first side of the hub and a second component adjacent the hub on a second side of the hub; the hub being deformable independent of the first component and of the second component, wherein the hub is a component of a drum assembly comprising the hub and the first component, wherein the first component comprises a first flange having a diameter greater than the hub, wherein the hub is attached to the first flange via at least one connector, wherein the drum assembly further comprises the second component, wherein the second component comprises a second flange having a diameter greater than the hub, wherein the hub is attached to the second flange via at least one connector, wherein the first flange and the second flange are connected to the hub via a generally central portion thereof which undergoes substantially no deformation, wherein the hub comprises a peripheral member about which the lifeline is coiled and at least one annular connecting member extending between the peripheral member and the generally central portion, at least a portion of the peripheral member and the connecting member being deformable to absorb energy in response to force exerted thereon by the lifeline, the connecting member extending axially along the hub a distance less than an axial length of the hub, wherein the annular connecting member is a disc.

18. An apparatus, comprising:

a lifeline system comprising a lifeline;

a hub around which the lifeline is coiled;

a first component adjacent the hub on a first side of the hub; and a second component adjacent the hub on a second side of the hub, the hub being deformable to absorb energy at a determined level of force exerted thereon by the lifeline independent of the first component and of the second component;

wherein the hub comprises a peripheral member about which the lifeline is coiled and at least one annular connecting member extending between the peripheral member and a generally central portion of the hub, at least a portion of the peripheral member and the connecting member being deformable to absorb energy in response to force exerted thereon by the lifeline; the connecting member extending axially along the hub a distance less than an axial length of the hub, wherein the annular connecting member is a disc.

19. The apparatus of claim 18 wherein the hub is a component of a drum assembly comprising the hub, the first component and the second component, wherein the first component comprises a first flange having a diameter greater than the hub and the second component comprises a second flange having a diameter greater than the hub.

20. The apparatus of claim 19 wherein the hub is attached to the first flange and the second flange via at least one connector.

21. The apparatus of claim 20 wherein the first flange and the second flange are connected to the hub via the generally central portion thereof which undergoes substantially no deformation.

22. The system of claim 1 further comprising at least a first flange on a first side of the hub, the hub being deformable independent of the first flange.

23. The system of claim 22 further comprising a second flange on a second side of the hub.

24. The system of claim 23 wherein the hub is deformable independent of the second flange.

25. A lifeline system, comprising:

a lifeline;

a hub around which the lifeline is coiled, the hub being deformable to absorb energy at a determined level of force exerted thereon by the lifeline so that a peak fall arrest force in a drop test of the lifeline system with a 220 pound mass attached to the lifeline over a distance of up to 6.56 feet is not more than 1900 pounds;

at least a first flange on a first side of the hub, the hub being deformable independent of the first flange;

a second flange on a second side of the hub, wherein the hub is deformable independent of the second flange;

wherein the hub comprises a peripheral member about which the lifeline is coiled and at least one annular connecting member extending between the peripheral member and a generally central portion of the hub, at least a portion of the peripheral member and the connecting member being deformable to absorb energy in response to force exerted thereon by the lifeline; the connecting member extending axially along the hub a distance less than an axial length of the hub, wherein the annular connecting member is a disc.

26. A lifeline system, comprising:

a lifeline; and a hub around which the lifeline is coiled, the hub being deformable to absorb energy at a determined level of force exerted thereon by the lifeline, wherein a first flange and a second flange are connected to the hub via a generally central portion thereof which undergoes substantially no deformation, and wherein the hub comprises a peripheral member about which the lifeline is coiled and at least one annular connecting member extending between the peripheral member and the generally central portion, at least a portion of the peripheral member and the connecting member being deformable to absorb energy in response to force exerted thereon by the lifeline, the connecting member extending axially along the hub a distance less than an axial length of the hub, wherein the annular connecting member is a disc.

27. A lifeline system, comprising:

a lifeline;

a hub around which the lifeline is coiled, the hub being deformable to absorb energy at a determined level of force exerted thereon by the lifeline;

wherein the hub comprises a peripheral member about which the lifeline is coiled and at least one annular connecting member extending between the peripheral member and a generally central portion of the hub, at least a portion of the peripheral member and the connecting member being deformable to absorb energy in response to a force exerted thereon by the lifeline; and wherein the connecting member extends axially along the hub a distance less than an axial length of the hub, wherein the annular connecting member is a disc.

28. The system of claim 1 wherein the annular disc is a planar disc.

29. The system of claim 17 wherein the annular disc is a planar disc.

30. The apparatus of claim 18 wherein the annular disc is a planar disc.

31. The system of claim 25 wherein the annular disc is a planar disc.

32. The system of claim 26 wherein the annular disc is a planar disc.

33. The system of claim 27 wherein the annular disc is a planar disc.

* * * * *